US012716375B2

(12) United States Patent
Khadiya

(10) Patent No.: US 12,716,375 B2
(45) Date of Patent: Aug. 25, 2026

(54) WORK VEHICLE AND AFTERTREATMENT SYSTEM THEREFOR

(71) Applicant: Deere & Company, Moline, IL (US)

(72) Inventor: Navin Khadiya, Cedar Falls, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 19/042,370

(22) Filed: Jan. 31, 2025

(65) Prior Publication Data

US 2026/0226857 A1 Aug. 6, 2026

(51) Int. Cl.
*F01N 3/20* (2006.01)

(52) U.S. Cl.
CPC ..... *F01N 3/2066* (2013.01); *F01N 2560/025* (2013.01); *F01N 2560/06* (2013.01); *F01N 2610/04* (2013.01)

(58) Field of Classification Search
CPC ..... F01N 3/2066; F01N 2560/025; F01N 2560/06; F01N 2610/04
See application file for complete search history.

(56) References Cited

U.S. PATENT DOCUMENTS

| | | | | |
|---|---|---|---|---|
| 2012/0047874 | A1* | 3/2012 | Schmieg | B01J 37/0246 60/303 |
| 2019/0232224 | A1* | 8/2019 | Adelman | F01N 3/106 |
| 2019/0353065 | A1* | 11/2019 | Dong | F01N 11/00 |

FOREIGN PATENT DOCUMENTS

| | | | | |
|---|---|---|---|---|
| CA | 2776052 | A1 * | 4/2009 | F02D 41/146 |
| CN | 101149010 | A * | 3/2008 | F01N 3/00 |
| CN | 119195891 | A * | 12/2024 | F01N 3/2033 |
| DE | 112016002717 | B4 * | 3/2025 | F01N 3/2066 |
| WO | WO-2018185665 | A1 * | 10/2018 | F01N 3/2066 |
| WO | WO-2022055852 | A1 * | 3/2022 | F01N 9/00 |
| WO | WO-2023141293 | A1 * | 7/2023 | F01N 9/00 |

OTHER PUBLICATIONS

Herreros, J.M. et al., "Enhancing the low temperature oxidation performance over a Pt and a Pt-Pd diesel oxidation catalyst", Applied Catalysis B: Environmental 147 (2014) 835-841, journal homepage: www.elsevier.com/locate/apcatb, received Jul. 17, 2013, accepted Oct. 7, 2013, available online Oct. 15, 2013. (7 pages).

(Continued)

*Primary Examiner* — Ngoc T Nguyen
(74) *Attorney, Agent, or Firm* — KLINTWORTH

(57) ABSTRACT

A work vehicle includes an engine that generates exhaust gases that flow through an exhaust flow path, a diesel oxidation catalyst (DOC), a nitrogen-oxide (NOx) reduction device, a tank of hydrogen gas, and a temperature sensor sensing a temperature associated with the exhaust gases proximate the DOC. The DOC and the NOx reduction device are disposed in the exhaust flow path. In addition, the work vehicle includes a flow control device between the tank of hydrogen gas and the exhaust flow path between the engine and the DOC. The flow control device is operable to control a flow of hydrogen gas from the tank of hydrogen gas into the exhaust flow path and the flow of hydrogen gas is adjusted in accordance with the sensed temperature.

16 Claims, 6 Drawing Sheets

(56) References Cited

OTHER PUBLICATIONS

Kirwan,John E. et al., (Delphi Automotive Systems) "Fast Start-Up On-Board Gasoline Reformer for Near Zero Emissions in Spark-Ignition Engines", SAE 2002 World Congress Mar. 4-7, 2002, SAE Technical Paper Series, 2002-01-1011, reprinted from: SI Combustion and Flow Diagnostics (SP-1699), downloaded from SAE International by Deere & Company, Jun. 27, 2024. (14 pages).

* cited by examiner

WORK VEHICLE AND AFTERTREATMENT SYSTEM THEREFOR

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure generally relates to internal combustion engine systems for work vehicles and aftertreatment systems for such engine systems.

BACKGROUND OF THE DISCLOSURE

Heavy-duty work vehicles, such as those used in the agricultural, construction, forestry, and mining industries, may utilize various propulsion systems and drive trains to provide tractive power to ground-engaging members (e.g., wheels or tracks) for travel and work operations of the work vehicle. Power sources, including various internal combustion engines, combust fuel to generate power for tractive and work operations of these work vehicles. Combustion of fuel generates noxious exhaust that is treated or converted by an aftertreatment system into more desirable gases before being exhausted from the work vehicle. For example, combustion of diesel fuel May generate hydrocarbons, carbon monoxide, oxides of nitrogen (NOx), and other gases that are converted by an aftertreatment system into carbon dioxide, nitrogen, and water vapor. The aftertreatment system includes one or more catalyst(s) that when heated sufficiently facilitates such conversion as gases produced by the engine system pass through the aftertreatment system.

SUMMARY OF THE DISCLOSURE

The present disclosure provides a work vehicle that includes an engine that generates exhaust gases that flow through an exhaust flow path. A diesel oxidation catalyst (DOC) and a nitrogen-oxide (NOx) reduction device are disposed in the exhaust flow path. The work vehicle also includes a tank of hydrogen gas and a temperature sensor sensing a temperature associated with the exhaust gases in the exhaust flow path proximate the DOC. The work vehicle further includes a flow control device between the tank of hydrogen gas and the exhaust flow path between the engine and the DOC. The flow control device is operable to control a flow of hydrogen gas from the tank of hydrogen gas into the exhaust flow path and the flow of hydrogen gas is adjusted in accordance with the sensed temperature.

The present disclosure also provides an aftertreatment system for a work vehicle having an engine that generates exhaust gases flowing through an exhaust flow path to an exhaust vent. The aftertreatment system includes a diesel oxidation catalyst (DOC), a nitrogen-oxide (NOX) reduction device, a temperature sensor sensing a temperature associated with the exhaust gases proximate the DOC, and a tank of hydrogen gas. The DOC and the NOx reduction device are disposed in the exhaust flow path. The aftertreatment system also includes a flow control device between the tank of hydrogen gas and the exhaust flow path between the engine and the DOC. The flow control device is operable to control a flow of hydrogen gas from the tank of hydrogen gas into the exhaust flow path and the flow of hydrogen gas is adjusted in accordance with the sensed temperature.

In some aspects or embodiments, the flow control device is operated to inject hydrogen gas into the exhaust flow path when the temperature exceeds a predetermined threshold temperature necessary for combustion of the hydrogen gas at the DOC.

In some aspects or embodiments, the temperature sensor comprises and a first temperature sensor and the temperature comprises a first temperature. The work vehicle or aftertreatment system further including a second temperature sensor sensing a second temperature associated with exhaust gases in the exhaust flow path proximate the NOx reduction device and the flow control device is operated to inject hydrogen gas into the exhaust flow path only when the second temperature is less than a second predetermined temperature associated with activation of the NOx reduction device.

In some aspects or embodiments, the work vehicle or aftertreatment system includes an oxygen sensor to sense oxygen in the exhaust gases in the exhaust flow path and the flow control device is operated in accordance with the sensed oxygen.

In some aspects or embodiments, the work vehicle or aftertreatment system includes a controller having a processor and memory architecture that is configured to operate the flow control device. In some cases, the controller is configured to estimate an expected change in an operating load of the engine and operate the flow control device in accordance with the expected change in the operating load of the engine. In addition, the controller estimates the expected change in the operating load in accordance with one or more of fuel demand or airflow into the engine. Further, in some cases, the expected change in the operating load is an increase in the operating load and the controller operates the flow control device to reduce the flow of hydrogen gas. In some cases, the controller operates the flow control device in accordance with an age of the DOC. Further, the controller develops an estimate of an expected temperature of the exhaust gases in the exhaust flow path proximate the NOx reduction device in accordance with the estimate of the change in the operating load of the engine and operates the flow control device in accordance with the estimated expected temperature.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
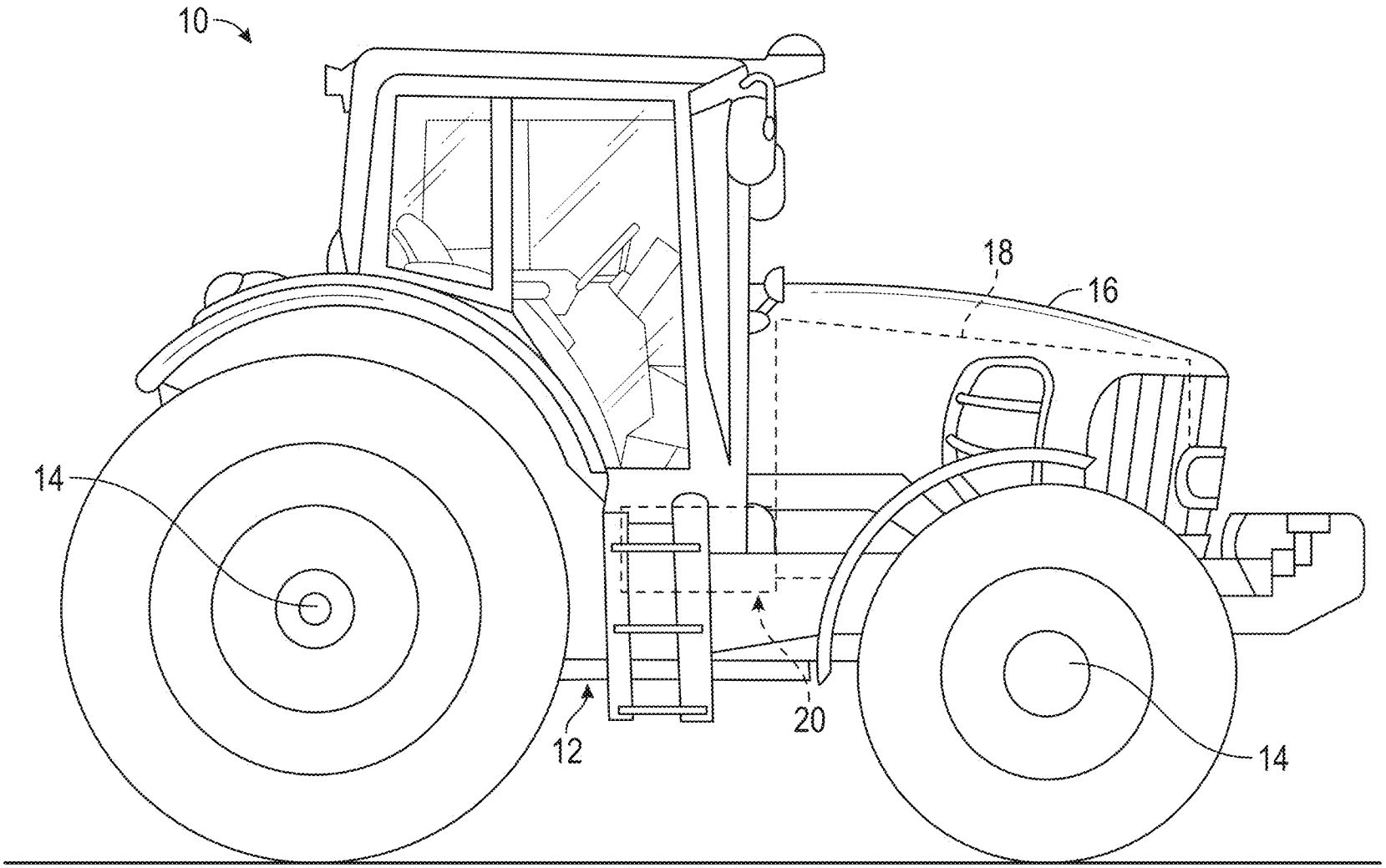
FIG. 1 is an example work vehicle in the form of an agricultural tractor in which the aftertreatment system of the present disclosure may be incorporated.

The following describes one or more example embodiments of the disclosed aftertreatment system for a work vehicle as shown in the accompanying figures of the drawings described briefly above. Various modifications to the example embodiments may be contemplated by one of skill in the art. Discussion herein focuses on the aftertreatment system being for a work vehicle, such as an agricultural tractor, but the aftertreatment system disclosed herein may be utilized in other contexts, including other work vehicle platforms in the agriculture, construction, forestry, mining, and other industries.

Overview

Power sources for work vehicles generate power necessary to undertake various work operations of the work vehicles such as to transport the work vehicles, transport loads carried by the work vehicles, operate electrical and mechanical auxiliary devices of the work vehicles including various work implements, and the like. The power sources may be, for example, an engine system including an internal combustion engine, and combustion of the fuel by such an engine may result in exhaust particulates such as soot and gases that may include hydrocarbons and oxides of nitrogen (NOx). Such exhaust gases may be passed through an aftertreatment system that treats the exhaust gases before being exhausted from the work vehicle. Various aftertreatment systems may include a diesel oxidation catalyst (DOC) that facilitates an oxidation reaction to convert hydrocarbons and carbon monoxide in the exhaust gases into carbon dioxide and water vapor, a particulate filter that entraps particulate matter in the exhaust, and an NOx reduction device that facilitates conversion of NOx in the exhaust into nitrogen and water vapor.

The NOx reduction device may include a catalyst, such as a selective catalytic reduction (SCR) catalyst that is typically inactive until it has been heated to at least a temperature threshold necessary to initiate catalysis. Such temperature threshold is conventionally referred to as a "light-off" temperature. Typically, heat from the exhaust gases passing through the NOx reduction device may facilitate heating the catalyst of such device. In a conventional aftertreatment system, heat generated by the power source may supply thermal energy to heat the SCR catalyst to the light-off temperature and thereafter to maintain the temperature of the SCR catalyst above a predetermined 4 temperature necessary for the SCR catalyst to remain active. In some cases, operation of the power source may be adjusted to generate sufficient power for both the work operations of the work vehicle and to raise the temperature of exhaust generated thereby. The heated exhaust may then supply thermal energy to heat the SCR catalyst. Alternately, an electric heater may be placed in the exhaust flow path between the power source and the SCR catalyst to heat the exhaust flowing through such path, which in turn may heat the SCR catalyst. Operating the power source in this manner may be fuel inefficient. Further, using the heater to the exhaust may also consume energy (that may have to be generated by the power source) and may require the work vehicle to have additional electrical infrastructure to support the heater.

In conventional aftertreatment systems, exhaust gases generated by the engine system may first pass through the DOC, the particulate filter, and the NOx reduction device. Oxidation of the hydrocarbons in the exhaust gases by the DOC comprises an exothermic reaction that may heat the exhaust gases and such heated exhaust gases may supply thermal energy that may be used to heat the SCR catalyst. However, the thermal energy of the exhaust gases treated by the DOC may not be sufficient when the engine is initially ignited or when the engine is operating with a low load to heat the SCR catalyst to the light-off temperature and maintain the predetermined temperature of the SCR catalyst so that such catalyst remains active. Further, the DOC and particulate filters are thermal masses that may draw heat from the exhaust gases as such gases pass therethrough and reduce the amount of heat available in the exhaust gases to heat the catalyst of the NOx reduction device.

Disclosed herein is an aftertreatment system in which exhaust gas generated by an engine flow through an exhaust flow path between the engine and an exhaust vent that includes a DOC and an SCR catalyst. In some embodiments, the aftertreatment system may include additional components disposed along the exhaust flow path including, for example, a particular filter, a diesel exhaust fluid (DEF) injector, an ammonia oxidation catalyst, and the like. The exhaust gas is treated by the DOC and the SCR catalyst and any additional components before being vented to the ambient environment. In some embodiments, the exhaust gases in the exhaust flow path flow through the DOC and then the SCR catalyst. In some cases, the DOC comprises a platinum group metal (PGM) catalyst. In addition, the aftertreatment system includes a hydrogen gas tank (or other source of hydrogen gas) configured to selectively inject hydrogen gas into the exhaust flow path between the engine and the DOC to mix with the exhaust gases in such flow path. Hydrogen gas has been found to catalytically combust in a PGM catalyst in the presence of oxygen at temperatures as low as 125 degrees Celsius and even at relatively small amount of hydrogen gas combusted in the DOC may produce sufficient exothermic energy to heat exhaust gases passing through the DOC to a temperature necessary to maintain the activation temperature of the SCR catalyst.

The hydrogen gas tank is coupled to an exhaust line between the engine and the DOC by a flow control device, for example a valve, operable by a controller. The controller monitors a first temperature of the exhaust gases entering the DOC and a second temperature of the exhaust gases in the exhaust flow path between the DOC and the SCR catalyst. The control system operates the flow control device to dose the exhaust passing through the exhaust flow path between the engine and the DOC with hydrogen gas if the first temperature is at least a first temperature threshold that is necessary to combust hydrogen gas in the DOC and if the second temperature is less than a second temperature threshold that, in some embodiments, is the light-off temperature necessary to activate the SCR catalyst.

The controller monitors an operating load of the engine and the second temperature after the second temperature has reached the second temperature threshold (e.g., the SCR catalyst light-off temperature). In some embodiments, the controller estimates an expected change in an operating load of the engine in accordance with, for example, an amount of fuel and/or air supplied to the engine to facilitate combustion and develops an estimate of the temperature of the exhaust gases entering the SCR catalyst as result of the change in the expected operating load. The controller operates the flow control device to reduce or increase the flow of hydrogen in accordance with the estimate of such temperature. For example, if the operating load of the engine is expected to increase, the controller estimates the increased in temperature of the exhaust gases entering the SCR catalyst and operates the flow control device to reduce the flow of hydrogen gas into the exhaust line in accordance with such expected increased temperature. Similarly, when the operating load of the engine is expected to decrease, the controller operates the flow control device to increase the flow of the hydrogen gas introduced into the exhaust line in accordance with the expected decreased temperature of exhaust gases into the SCR catalyst. The controller operates the flow control device in response to an increase or decrease in the expected operating load of the engine to inject sufficient hydrogen gas so the temperature of exhaust gases entering the SCR catalyst will be sufficient to keep the SCR catalyst active.

In some embodiments, the estimates of the increase or decrease in the temperature of the exhaust gases that enter the SCR catalyst as a result of the increase or decrease, respectively, of the operating load of the engine may take into account the thermal masses and/or inertia of the components (e.g., the DOC, particulate filter, etc.) in the exhaust path between the engine and the SCR catalyst that may absorb thermal energy from the exhaust gases before the exhaust gases reach the SCR catalyst. In some embodiments, such estimates may also be adjusted in accordance with the age of the DOC and/or particulate filter. For example, as the DOC ages, the temperature necessary to activate the DOC and exothermically combust hydrogen gas may change. Thus, the controller may adjust the estimates of the expected changes in temperature of the exhaust gases due to changes in the operating load of the engine based on the age of the DOC. In some embodiments, the controller monitors oxygen in the exhaust gases generated by the engine and operates the flow control device to adjust the flow of the hydrogen gas into the exhaust path in accordance with the oxygen in the exhaust gases. For example, the controller may reduce the flow of the hydrogen gas if sufficient oxygen is not available in the exhaust gases to combust the hydrogen gas even if such reduced flow is less than that necessary to raise the temperature of the exhaust gases entering the SCR catalyst to the second temperature threshold.

These and further aspects of the disclosed aftertreatment system will be better understood with regard to the one or more examples described hereinafter.

Example Aftertreatment System

Referring to FIG. 1, a work vehicle 10 is shown that can implement embodiments of the disclosure. In the illustrated example, the work vehicle 10 is depicted as an agricultural tractor. It will be understood, however, that other configurations may be possible, including configurations with the work vehicle 10 as a different kind of tractor, a harvester, a log skidder, a grader, or one of various other work vehicle platforms. The work vehicle 10 includes a frame or chassis 12 carried on one or more ground engagement members 14. Positioned on a forward end region of the chassis 12 is an engine housing 16 within which is located an engine system 18. The engine system 18 provides power via an associated powertrain 20 to an output member (e.g., an output shaft, not shown) that, in turn, transmits power to axle(s) of the work vehicle 10 to provide propulsion thereto to drive the ground engagement members 14 and/or to a power take-off shaft for powering an implement (not shown) on or associated with the work vehicle 10.

Figure 2:
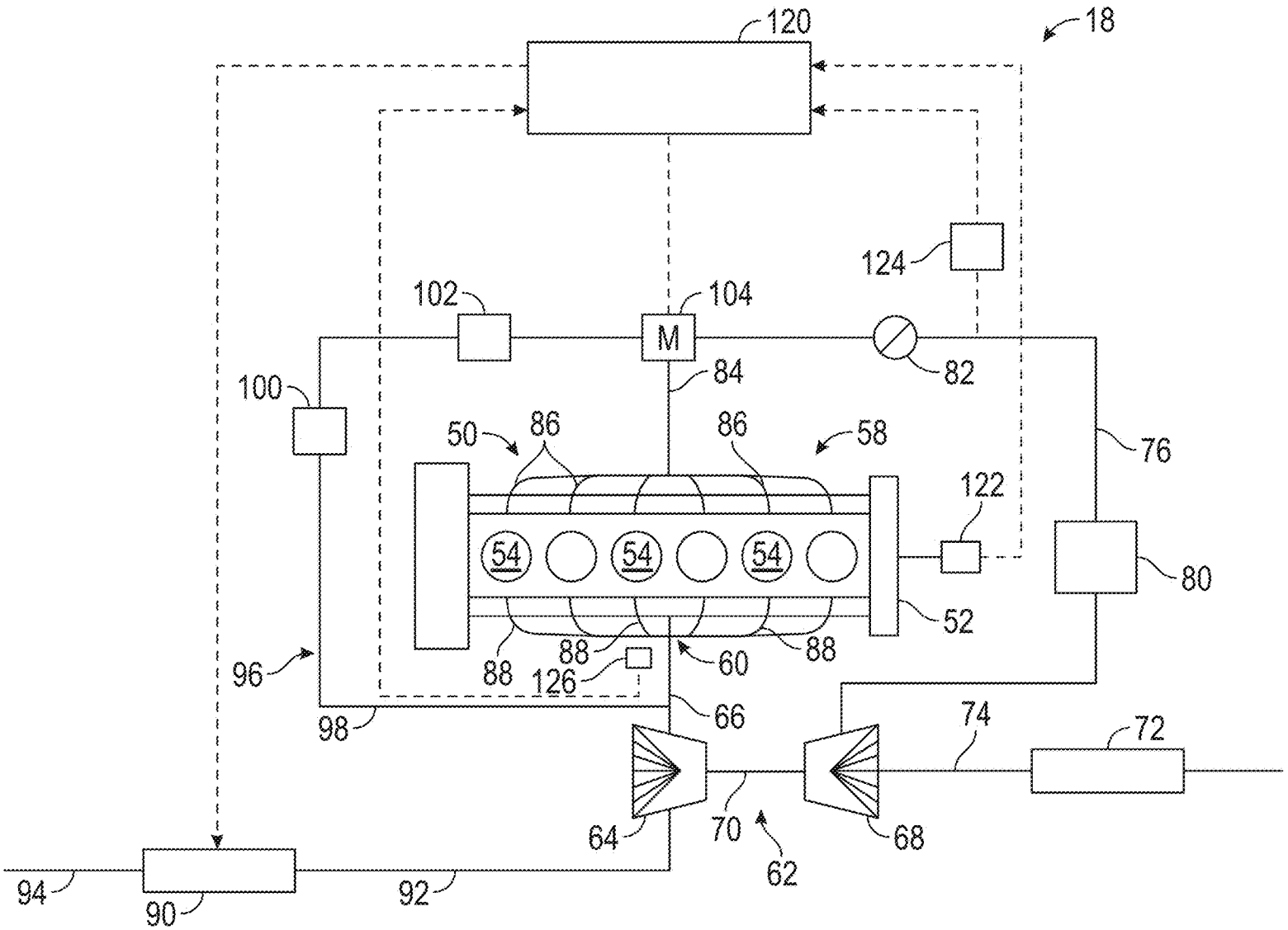
FIG. 2 is a schematic diagram of an example engine system of the work vehicle of FIG. 1.

The engine system 18 is illustrated in greater detail in FIG. 2 in accordance with an example implementation. Referring to FIG. 2, the engine system 18 includes a power source or engine 50 (hereafter, "engine") that, in the present embodiment may be a compression-ignition or spark-ignited internal combustion engine. The engine 50 of the engine system 18 includes an engine block 52 having a plurality of piston-cylinder arrangements 54. The plurality of piston-cylinder arrangements 54 operate to cause combustion events and thereby generate power necessary to operate the work vehicle 10. In the illustrated implementation, the engine 50 is an inline-6 (I-6) engine defining six piston-cylinder arrangements 54; however, in alternative implementations various engine styles and layouts may be used.

The engine system 18 also includes an intake manifold 58 fluidly connected to the engine 50, an exhaust manifold 60 fluidly connected to the engine 50, and a turbocharger assembly 62. The turbocharger assembly 62 includes a turbine 64 fluidly connected to the exhaust manifold 60 by an exhaust gas passageway 66 and a compressor 68 mechanically coupled to the turbine 64 via a rotatable shaft 70. The compressor 68 is fluidly connected to an air intake 72 that may include one or more intake components (e.g., an air filter, an air cooler, etc.) disposed in an air intake passageway 74. During operation of the engine 50, exhaust gases generated by the engine 50 pass through the exhaust gas passageway 66 and through the turbine 64 to cause the turbine 64 (and the rotatable shaft 70) to rotate. Rotation of the rotatable shaft 70 in turn causes the compressor 68 to rotate and draw fresh air through the air intake 72, through the air intake passageway 74, through the compressor 68, and into the intake manifold 58 via a charge air passageway 76. Operation of the turbocharger assembly 62 in this manner increases the flow of air into the intake manifold 58 above what it would otherwise be without the turbocharger assembly 62 and thus the turbocharger assembly 62 supplies so-called "charge" air to the engine 50. In some embodiments, a charge air cooler (i.e., an aftercooler) 80 is disposed in the charge air passageway 76 to cool the charge air. The charge air cooler 80 reduces the temperature of the charge air to increase the unit mass per unit volume (i.e., density) of the charge air prior to such charge air being provided to the engine 50 for improved volumetric efficiency thereof. An air intake throttle 82 is also disposed in the charge air passageway 76 and regulates a rate at which charge air is supplied to the intake manifold 58. The compressed charged air allowed to flow through the air intake throttle 82 flows through a main intake 84 of the intake manifold 58.

The main intake 84 of the intake manifold 58 is coupled to a plurality of secondary pipes 86 of the intake manifold 58 and each of the secondary pipes 86 is in fluid communication with a corresponding piston-cylinder arrangement 54 to direct a supply of charge air thereto.

The exhaust manifold 60 of the engine system 18 includes a plurality of secondary pipes 88, each of which is in fluid communication with a corresponding piston-cylinder arrangement 54. The plurality of secondary pipes 88 direct the exhaust gases generated by the engine 50 to the exhaust gas passageway 66 of the exhaust manifold 60. As described above, the exhaust gas passageway 66 of the exhaust manifold 60 is fluidly coupled to and causes rotation of the turbine 64 of the turbocharger assembly 62 and thereby causes more ambient air to be drawn into the air intake passageway 74.

A first portion of the exhaust gases in the exhaust gas passageway 66 then exits the turbine 64 and into an aftertreatment system 90 via an aftertreatment passageway 92. The aftertreatment system 90 treats the exhaust gases prior to the treated exhaust gases being vented to the ambient environment via an exhaust outlet or exhaust vent 94 of the work vehicle 10. A second portion of the exhaust gases in the exhaust gas passageway 66 may be directed to an exhaust gas recirculation (EGR) system 96 that includes an EGR passageway 98, an EGR cooler 100 disposed in the EGR passageway 98, and an EGR valve 102. Operation of the EGR valve 102 draws the second portion of the exhaust gases from the exhaust gas passageway 66 through the EGR passageway 98, through the EGR cooler 100, through the EGR valve 102, and into a mixer 104. Operation of the EGR valve 102 may be varied to determine the second portion of the exhaust gases in the exhaust gas passageway 66 that is drawn into the EGR system 96. The EGR cooler 100 cools the exhaust gases that flow through the EGR passageway 98 before such gases are supplied to the mixer 104. The second portion of the exhaust gases and the charge air drawn through the air intake passageway 74 combine in the mixer 104 before flowing into the main intake 84 of the intake manifold 58. The EGR system 96 functions to recirculate a portion of the exhaust gases generated by the engine 50 and thereby reduce the formation of oxides of nitrogen (NOx) during combustion.

Figure 3:
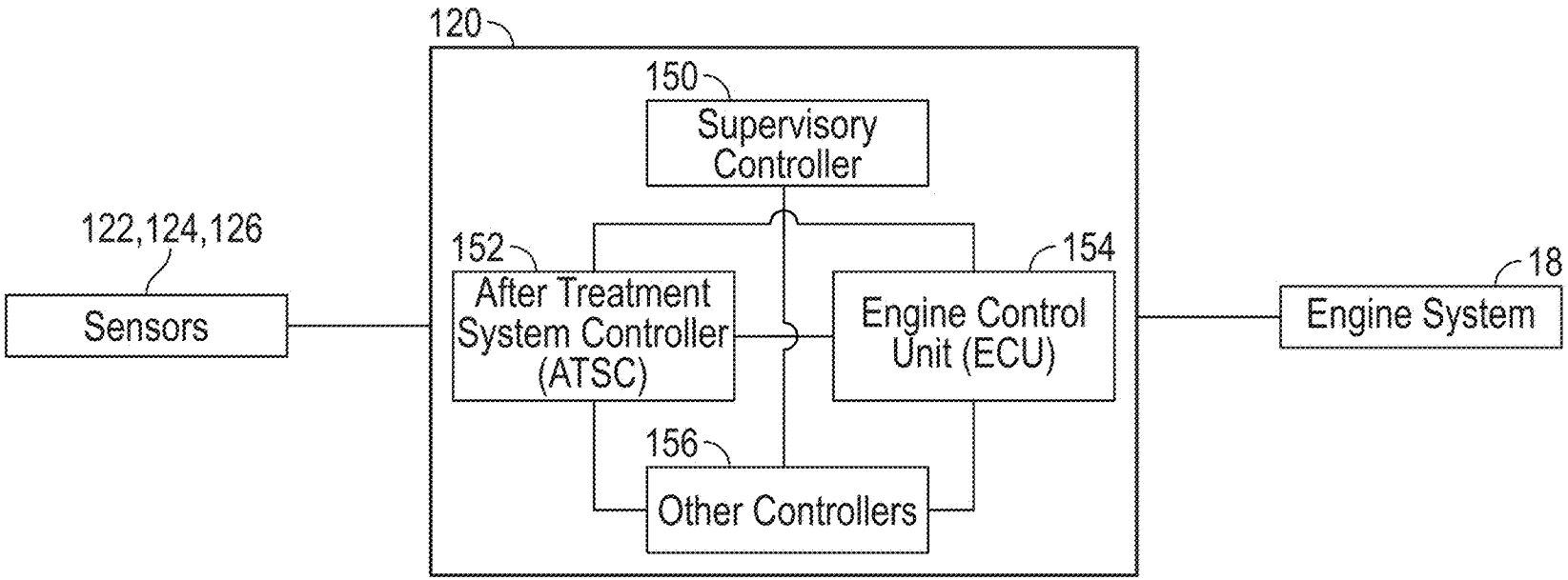
FIG. 3 is a schematic diagram of a control system of the engine system of FIG. 2.

Referring to FIGS. 2 and 3, the engine system 18 includes a control system 120 and various sensors including: an engine speed sensor 122; one or more sensor(s) 124 disposed in the intake manifold 58 or the air intake 72 that measure one or more of mass airflow, air temperature, and air pressure in the intake manifold 58 and/or the air intake 72; and one or more sensor(s) 126 in the exhaust manifold 60, the exhaust gas passageway 66, the aftertreatment system 90, and/or the aftertreatment passageway 92 that measures any or all of an oxygen level, temperature, and pressure of exhaust generated by the engine 50.

The control system 120 monitors signals or data received from the sensors 122, 124, and 126 described above and adjusts operation of the engine system 18 to ensure the work vehicle 10 is able to meet the demands placed on the work vehicle 10 by an operator while managing fuel efficiency and reduction of hazardous exhaust gases released to the ambient environment. In particular, the control system 120 includes a supervisory controller 150, an aftertreatment system controller (ATSC) 152 that manages operation of the aftertreatment system 90 to treat exhaust gases generated by the engine 50, and an electronic control unit (ECU) 154 that optimizes operation of the engine 50. The control system 120 may also include one or more additional controller(s) 156 such as an operator interface controller, a climate control system, a traction system controller, an accessory and/or hydraulic system controller, a work implement controller, and various others.

The supervisory controller 150 initiates operation of the ATSC 152, the ECU 154, and the additional controllers 156 when the work vehicle 10 is started by the operator (e.g., when the operator of the work vehicle 10 actuates an ignition of the work vehicle 10), monitors operation of such controllers 152, 154, and 156 during operation of the work vehicle 10, and shuts down such controllers 152, 154, and 156 when the operator turns off the work vehicle 10. The supervisory controller 150, the ATSC 152, the ECU 154, and the additional controllers 156 exchange signals and/or data therebetween as necessary to maintain efficient and clean operation of the engine system 18 (and thereby the work vehicle 10).

Figure 3A:
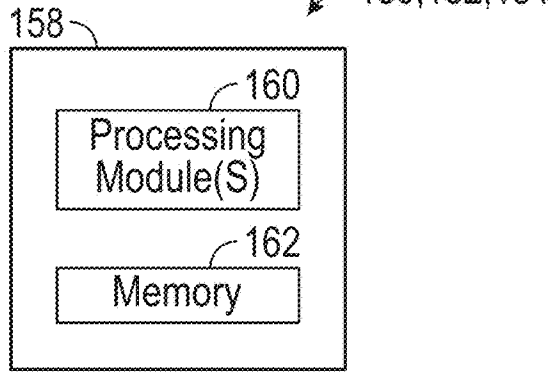
FIG. 3A is a schematic diagram of a computer-based device that may implement the components of the control system of FIG. 3.

Referring also to FIG. 3A, the supervisory controller 150, the ATSC 152, the ECU 154, and the additional controllers 156 may be implemented using hardware, software, firmware, or combinations thereof. In the illustrated embodiment, such components 150, 152, 154, and 156 of the control system 120 may be implemented by one or more suitably programmed computer-based device(s) 158, some or each having one or more processing device(s) 160 and one or more memory device(s) 162. The one or more memory device(s) 162 has stored therein, among other things, programming instructions executed by one or more processing device(s) 160 to cause the controllers 150, 152, 154, and 156 to undertake functions of the engine system 18 as described herein.

Each computer-based device 158 may comprise, e.g., a computer, a device using one or more application specific integrated circuits (ASIC's) and/or field-programmable gate arrays (FPGA's), and/or combinations thereof. Such device 158 may be unitary or may be distributed multiple computing devices, and one or more such computing devices may be installed locally on or remote from the work vehicle 10. Each computer-based device 158 may communicate with another computing device over one or more network(s) such as a local area network (LAN), a control area network (CAN), a cellular network, a wide area network (WAN) such as the Internet, and the like. One or more components 150, 152, 154, and 156 of the control system 120 also may be coupled to and responsive to one or more user device(s) (not shown) such as a keyboard, a mouse, a display, a touchscreen, a joystick, etc. (not shown) via which an operator may monitor and direct operation of the work vehicle 10.

As discussed above, the ATSC 152 monitors operation of the engine 50 and temperatures of exhaust gases flowing through components of the aftertreatment system 90 and adjusts an amount of hydrogen gas introduced into the exhaust gases to affect such temperatures, which in turn facilitates activation of the components of aftertreatment system 90 to treat such exhaust gases.

Figure 4:
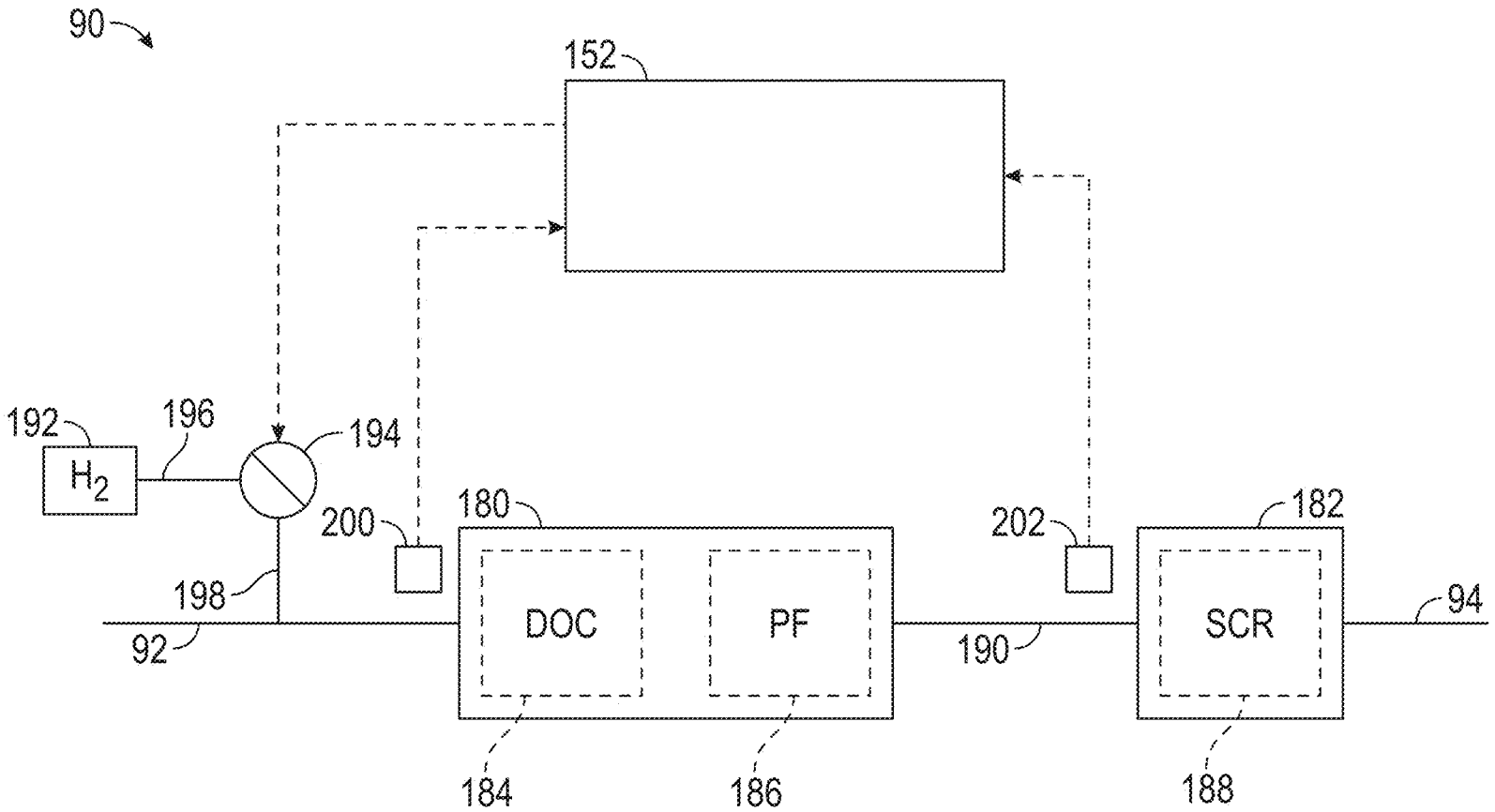
FIG. 4 is a schematic diagram of an aftertreatment system of the engine system of FIG. 2.

Referring to FIG. 4, an embodiment of the aftertreatment system 90 includes a DOC housing 180 and an NOx reduction device housing 182. A DOC 184 and a particulate filter 186 are disposed in the DOC housing 180 and a NOx reduction device 188, e.g., an SCR catalyst, is disposed in the NOx reduction device housing 182. In some embodiments, the DOC 184 and the particulate filter 186 may be separate components disposed in the DOC housing 180 or functionality of the DOC 184 may be integrated with that of the particulate filter 186 (e.g., if the particulate filter 186 is a cDPF, a DOCF, and the like) into a single component disposed in the DOC housing 180. In the following disclosure, the term "DOC" is used to refer to a standalone DOC or a DOC integrated with a particular filter. The aftertreatment passageway 92 is coupled to the DOC housing 180, the DOC housing 180 and the NOx reduction device housing 182 are fluidically coupled to one another by an NOx reduction device input line 190 and the exhaust vent 94 is coupled to the NOx reduction device housing 182. Thus, exhaust gases generated by the engine 50 that are not diverted into the EGR system 96 are directed into the DOC housing 180 via the aftertreatment passageway 92, treated by the DOC 184 and the particulate filter 186, and flow into the NOx reduction device housing 182 via the NOx reduction device input line 190 to be processed by the SCR catalyst 188. Thereafter, the exhaust gases treated by the DOC 184, the particulate filter 186, and SCR catalyst 188 flow from the NOx reduction device housing 182 to the exhaust vent 94 for release into the ambient environment.

The aftertreatment system 90 also includes a hydrogen gas tank (or other source of hydrogen gas) 192 and a flow control device 194 that couples a hydrogen gas output line 196 from the hydrogen gas tank 192 to a hydrogen gas dosing line 198 fluidically coupled to the aftertreatment passageway 92. In some embodiments, the hydrogen gas tank 192 is a pressurized source of compressed hydrogen gas and one or more of the hydrogen gas output line 196 and the hydrogen gas dosing line 198 may be high pressure fluid lines. The aftertreatment system 90 also includes a first temperature sensor 200 that senses a first temperature of the exhaust gases in the aftertreatment passageway 92 and a second temperature sensor 202 that senses a second temperature of the exhaust gases in the NOx reduction device input line 190. As described in greater detail below, the ATSC 152 monitors operation of the engine 50, the first temperature, and the second temperature and in response operates the flow control device 194 to control a flow of hydrogen gas from the hydrogen gas tank 192 to the aftertreatment passageway 92. Control of the flow of hydrogen gas by the flow control device 194 may adjust a rate at which hydrogen gas is allowed to flow into the aftertreatment passageway 92 such as, for example, flow of a volume of hydrogen gas over time, mass of hydrogen gas over time, and the like. In this manner, a selected amount of hydrogen gas is mixed with the exhaust gases in the aftertreatment passageway 92 before such mixture flows into the DOC housing 180. Hydrogen gas that is supplied into the DOC housing 180 in this manner combusts exothermically on the DOC 184 and thereby increases the temperature of the exhaust gases supplied to the NOx reduction device input line 190, and thus the NOx reduction device housing 182, compared to a temperature of such exhaust gases in the absence of hydrogen gas supplied to the DOC housing 180. Such increase in temperature of the exhaust gases supplied to the NOx reduction device input line 190 facilitates raising the temperature of the SCR catalyst 188 to an activation temperature thereof when the temperature of the exhaust gases generated by the engine alone may not be sufficient to activate or maintain activation of the SCR catalyst 188 such as, for example, when the engine is initially ignited and/or when the engine is operating at a low load. In some embodiments, the minimum flow of hydrogen may be that necessary to achieve a lower flammability limit of hydrogen and may be at an equivalence ratio of approximately 0.1 or an air/hydrogen ratio by mass of approximately 3.5. The maximum flow may be determined in accordance the desired change in temperature of the exhaust gases in the aftertreatment line 92 between the DOC 184 and the SRC catalyst 188 and oxygen in the exhaust gases.

Additional components such as, for example, a hydrocarbon injector, a diesel exhaust fluid injector, an ammonia oxidation catalyst, and the like may be disposed in the exhaust flow path between the aftertreatment passageway 92 and the exhaust vent as would be apparent to one who has ordinary skill in the art to facilitate operation of the aftertreatment system 90.

Figure 5:
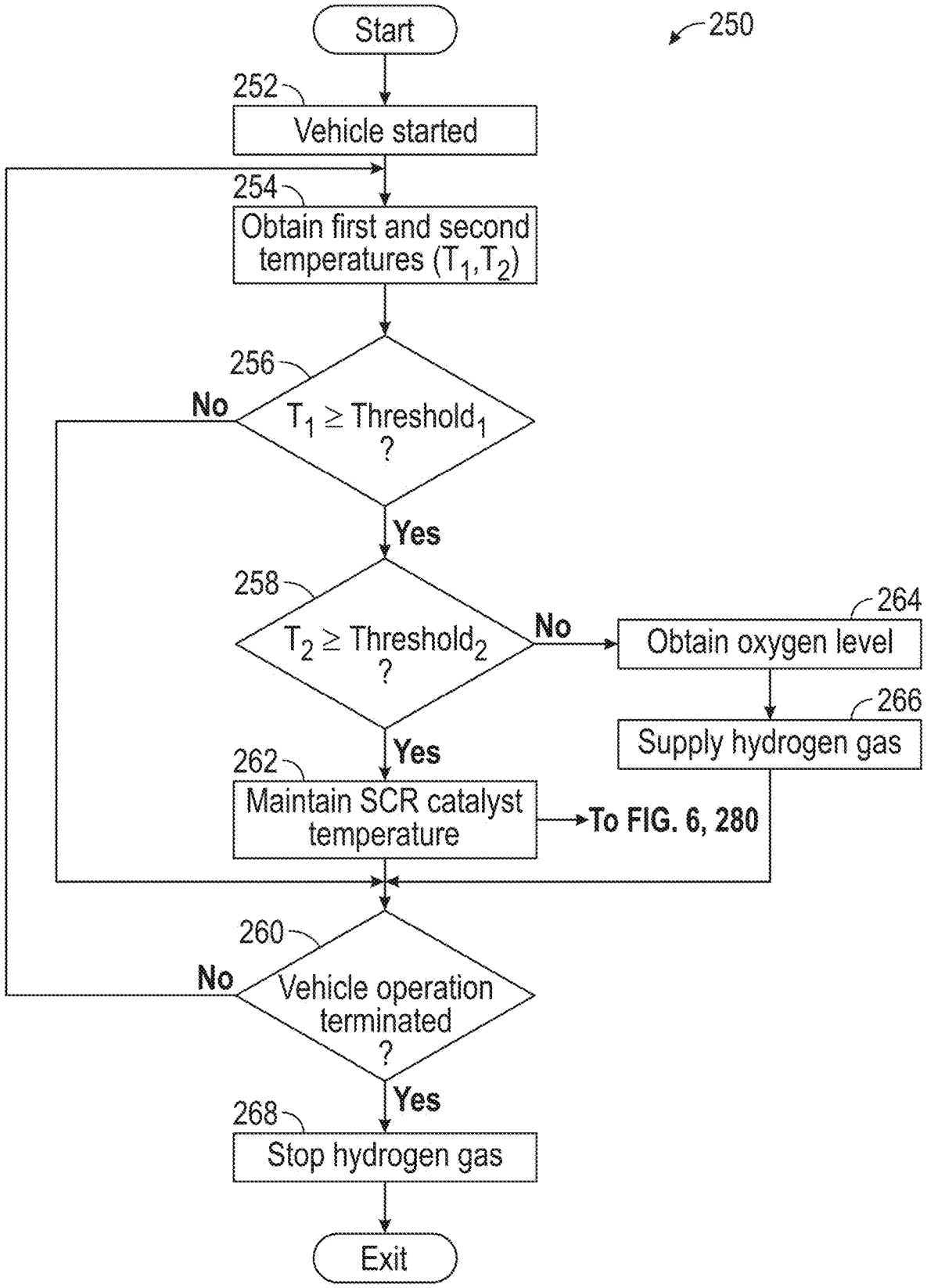
FIG. 5 is a process diagram for an aftertreatment control system to operate the aftertreatment system of FIG. 4.

FIG. 5 is a process diagram 250 of steps undertaken by the ATSC 152 to control the amount of hydrogen mixed with exhaust gases supplied and combusted at the DOC 184 to raise the temperature of the exhaust gases supplied NOx reduction device housing 182 to activate and/or maintain activation of the SCR catalyst 188 disposed therein. Referring to FIGS. 2-5, at step 252, the ATSC 152 receives a signal and/or data from the supervisory controller 150 that the operator has turned on the work vehicle 10 and the engine 50 has been ignited. At step 254, the ATSC 152 obtains a first temperature ($T_1$) of the exhaust gases entering the DOC housing 180 (i.e., in the aftertreatment passageway 92) from the first temperature sensor 200 and a second temperature ($T_2$) of the exhaust gases entering the NOx reduction device housing 182 (i.e., in the NOx reduction device input line 190) from the second temperature sensor 202. At step 256, the ATSC 152 determines if the first temperature is at least a predetermined first temperature threshold ($Threshold_1$) and, if so, proceeds to step 258. Otherwise, the ATSC proceeds to step 260. The first temperature threshold is a desired temperature of a mixture of exhaust gases and hydrogen supplied to the DOC 184. When the temperature of the mixture is at least the first temperature threshold, hydrogen gas in the exhaust gases undergoes exothermic combustion while the exhaust gases are treated in the DOC 184 and such exothermic combustion raises the temperature of the exhaust gases that are supplied to the NOx reduction device input line 190. In some embodiments, the first temperature threshold is a value selected between approximately 100 degrees Celsius and approximately 150 degrees Celsius in accordance with the materials and components that comprise the aftertreatment system 90. In some cases, the predetermined first temperature threshold is at least 100 degrees Celsius. Further, in some embodiments, the ATSC 152 may revise the predetermined first temperature threshold to reflect aging of the components of the DOC 184. For example, as the DOC 184 ages, the first threshold temperature necessary to cause combustion of the hydrogen on the DOC 184 may increase. The control system 120 maintains information regarding the age of the DOC 184 and the ATSC 152 (or another component of the control system 120) may periodically adjust the predetermined first threshold to reflect aging of the DOC 184. In some embodiments, the first temperature sensor 200 is proximate the input of the DOC housing 180 (or even within the housing proximate the DOC 184) so that there is minimal reduction in the temperature of the mixture of exhaust gases and hydrogen gas as such mixture flows between the first temperature sensor 200 and the DOC 184. Thus, the first temperature substantially represents the temperature of the mixture that reaches the DOC 184. It should be apparent to one who has ordinary skill in the art that a higher first temperature threshold may be selected if the first temperature sensor is not proximate the DOC housing 180 and/or the DOC 184 to compensate for any thermal loss in the mixture that may occur as the mixture flows between the first temperature sensor 200 and the DOC 184.

At step 258, the ATSC 152 determines if the second temperature is at least a predetermined second temperature threshold ($Threshold_2$), i.e., the SCR catalyst 188 has reached the light-off temperature, and if so proceeds to step 262. Otherwise, the ATSC 152 proceeds to step 264. The second temperature threshold is a temperature of the exhaust gases supplied to the NOx reduction device housing 182 for the SCR catalyst 188 to reach a light-off temperature and become activated to treat the exhaust gases passing therethrough. In some embodiments, the second temperature threshold is at least 250 degrees Celsius. In some embodiments, the second temperature sensor 202 is proximate the input of the NOx reduction device housing 182 (or even within the housing 182 and proximate the SCR catalyst 188) so that there is minimal loss of thermal energy of the exhaust gases as such gases flow between the second temperature sensor 202 and the SCR catalyst 188. Thus, the second temperature substantially represents the temperature of the exhaust gases that reach the SCR catalyst 188. It should be apparent to one who has ordinary skill in the art that a higher second temperature threshold may be selected if the second temperature sensor 202 is not proximate the NOx reduction device housing 182 and/or the SCR catalyst 188 to compensate for any thermal loss in the exhaust gases that may occur as they flow between the second temperature sensor 202 and the SCR catalyst 188.

If the second temperature is at least than the second temperature threshold at step 258, the temperature of the SCR catalyst 188 has reached at least the light-off temperature thereof and has become activated. In such cases, the ATSC 152 proceeds to step 262 to maintain the activation of the SCR catalyst 188, and then proceeds to step 260. Otherwise, the ATSC 152, at step 264, obtains from the sensor 126 oxygen (e.g., an amount, level, concentration, and the like of oxygen) present in the exhaust gases in the aftertreatment passageway 92. In some embodiments, the ATSC 152 may estimate the amount of oxygen expected in the exhaust gases in accordance with engine speed and/or engine load, e.g., by calculated such amount of oxygen or using a predetermined look up table that provides such information. At step 266, the ATSC 152 operates the flow control device 194 to cause hydrogen gas to flow from the hydrogen gas tank 192 into the aftertreatment passageway 92. Further, in some embodiment, the ATSC 152 operates the flow control device 194 in accordance with the oxygen in the exhaust gases so that all of the hydrogen gas will be combusted at the DOC 184. In other embodiments, the ATSC 152 may not determine the oxygen in the exhaust gases and operates the flow control device 194 at a predetermined rate associated with startup of the work vehicle 10 or engine 50. In some cases, the ATSC 152 determines a difference between the first temperature and the first predetermined threshold and selects or scales the flow of the hydrogen gas in accordance with such difference so that a greater difference results in a higher flow of the hydrogen gas and thus more hydrogen gas being mixed with the exhaust gases. Thereafter, the ATSC 152 proceeds to step 260.

At step 260, the ATSC 152 determines if a signal has been received from the supervisory controller 150 that indicates the operator has terminated operation of the work vehicle 10 and/or engine 50. If so, at step 268, the ATSC 152 operates the flow control device 194 to stop any flow of hydrogen gas from the hydrogen gas tank 192 and exits. Otherwise, the ATSC 152 returns to step 254.

Figure 6:
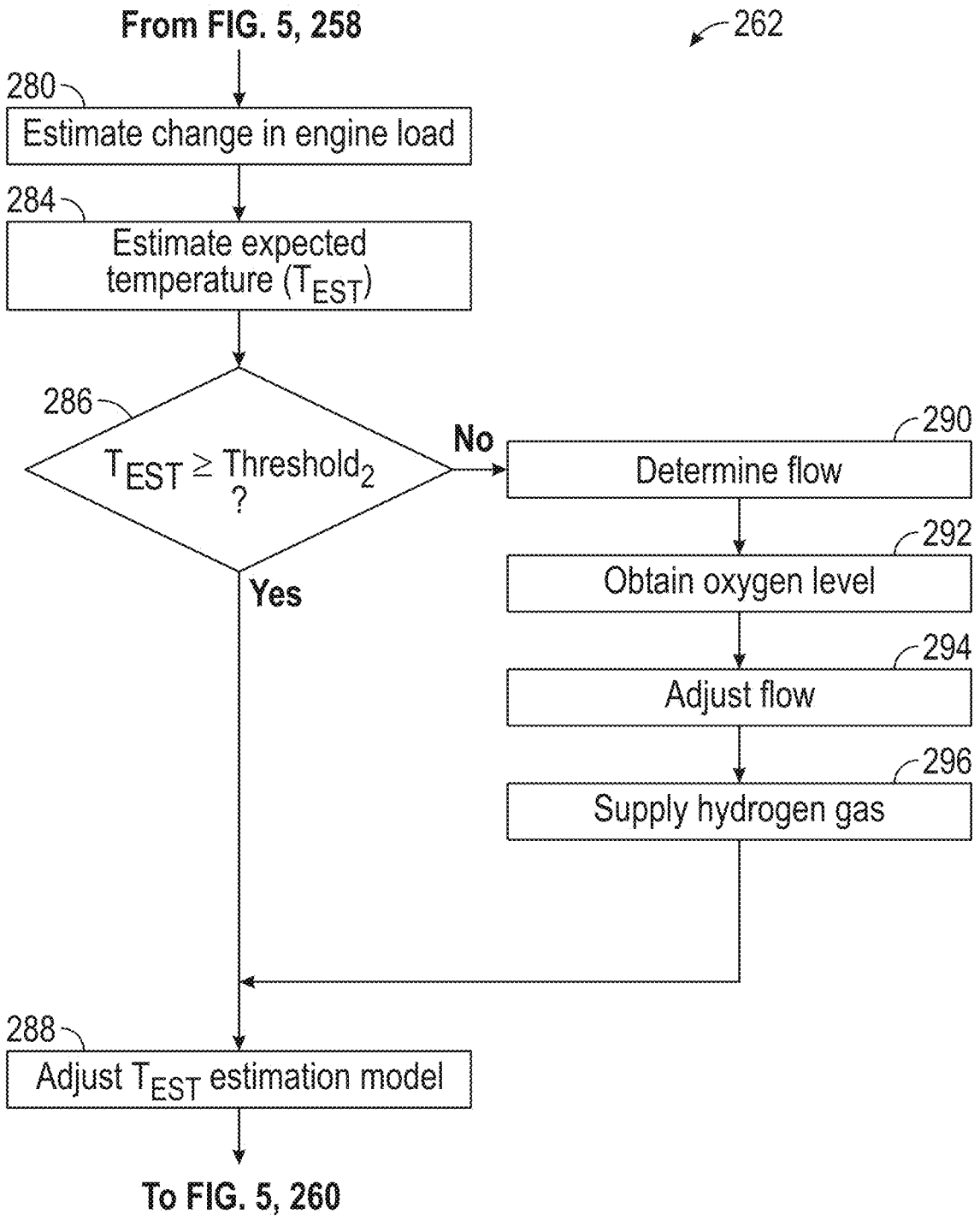
FIG. 6 is a process diagram for the aftertreatment control system to maintain a temperature of the aftertreatment system of FIG. 4.

FIG. 6 shows a process diagram of steps undertaken by the ATSC 152 to maintain the temperature of the SCR catalyst 188 at step 262 of FIG. 5. Referring also to FIG. 6, the ATSC 152, at step 280, monitors engine fuel flow commands generated by the ECU 154, the amount of air supplied to the engine as sensed by the sensor 124, and the like to develop an estimate of any expected increase or decrease in the engine load. At step 284, the ATSC 152 develops an estimate of an expected temperature ($T_{EST}$) of the exhaust gases that will reach the SCR catalyst 188 in accordance with the expected change in the operating load of the engine. The temperature of the exhaust gases sensed by the second temperature sensor 202 may not reach the estimated expected temperature until the engine has been operated at the increased or decreased engine load for a period of time. The expected temperature of exhaust gases that will reach the SCR catalyst 188 may be estimated, for example, in accordance with the temperature of the exhaust gas that is generated by the engine 50 at the expected operating load and thermal energy that would be transferred from such generated exhaust gas to components between the engine 50 and the SCR catalyst 188 through which the exhaust gases pass including, for example, the exhaust manifold 60, the aftertreatment passageway 92, the DOC 184 and the particulate filter 186. In some embodiments, the ATSC 152 may use an expected engine speed and the expected operating load of the engine to calculate expected enthalpy (i.e., energy) of the exhaust gases that may be available to heat the SRC catalyst 188. In some embodiments, such expected enthalpy may be provided in a predetermined lookup table (e.g., an engine calibration table, and the like) that provides expected enthalpy of exhaust gases at different engine speeds/loads.

At step 286, the ATSC 152 determines if the estimated temperature of exhaust gases that will reach the SCR catalyst 188 is at least the predetermined second threshold and if so proceeds to step 288. Otherwise, the ATSC 152, at step 290 determines a change in the flow of the hydrogen gas to inject into the aftertreatment passageway 92 to compensate for the expected change in operating load of the engine 50 (and corresponding expected change in the exhaust gas temperature) determined at step 280. In particular, the ATSC 152 increases the flow of the hydrogen gas in accordance with an expected reduction in the engine load and decreases the flow of the hydrogen gas in accordance with an expected increase in the engine load. In some embodiments, the amount of the increase or decrease in flow of the hydrogen gas varies in accordance with an amount of the expected decrease or increase, respectively, in the operating load of the engine 50.

At step 292, the ATSC 152 determines an estimate of oxygen expected in the exhaust gases generated by the engine 50 when operated at the increased or decreased operating load. At step 294, the ATSC 152 adjusts the flow of the hydrogen gas determined at step 290 in accordance with the estimated oxygen to avoid introducing excess hydrogen gas into the exhaust gases that may not be combusted because of a lack of oxygen. At step 296, the ATSC 152 operates the flow control device 194 in accordance with the flow of the hydrogen gas as adjusted at step 294 to increase or decrease (or not change) the flow of the hydrogen gas supplied to the aftertreatment passageway 92 to mix with exhaust gases therein. The ATSC 152 then proceeds to step 288.

At step 288, the ATSC 152 may periodically analyze a difference between the estimated temperature of exhaust gases at the SCR catalyst 188 expected in response to the change in the operating load of the engine 50 as determined at step 284 and the actual temperature of the exhaust gases when the engine 50 is operating at the changed operating load. The ATSC 152 adjusts parameters of the model used to estimate the expected temperature in accordance with such difference, also at step 288. Thereafter, the ATSC 152 proceeds to step 260 (FIG. 5) described above. It should be apparent that adjustments to flow of the hydrogen gas as described above may be followed by appropriate idle periods to allow such adjustments to be reflected in the temperatures of the exhaust gases that pass through the components of the aftertreatment system 90 and operation thereof.

It should be understood from the foregoing that the ATSC 152 operates the flow control device 194 to introduce hydrogen gas into that exhaust flow path only when the second temperature as sensed at step 254 and the expected second temperature estimated 284 are less than the second predetermined threshold (i.e., not sufficient to activate or maintain activation of the SCR catalyst 188). Otherwise, the ATSC 152 operates the flow control device 194 to cease flow of the hydrogen gas into the exhaust flow path until the second temperature or the expected second temperature is less than the second predetermined threshold.

Although the embodiments disclosed herein are described in connection with a work vehicle having an engine system 18 comprising an internal combustion engine, it should be apparent to one who has ordinary skill in the art that aspects of these embodiments may be adapted to other types of work vehicles having other types of engines to manage aftertreatment of exhaust gases generated thereby. Further, aspects of such embodiments may even be used in other types of engines or motors not associated with vehicles as appropriate.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

The description of the present disclosure has been presented for purposes of illustration and description, but it is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A work vehicle, the work vehicle comprising:

an engine that generates exhaust gases that flow through an exhaust flow path;

a diesel oxidation catalyst (DOC) disposed in the exhaust flow path;

a nitrogen-oxide (NOX) reduction device disposed in the exhaust flow path;

a tank of hydrogen gas;

a temperature sensor sensing a temperature associated with the exhaust gases in the exhaust flow path proximate the DOC; and a flow control device between the tank of hydrogen gas and the exhaust flow path between the engine and the DOC, wherein the flow control device is operable to control a flow of hydrogen gas from the tank of hydrogen gas into the exhaust flow path;

wherein the flow of hydrogen gas is adjusted in accordance with the sensed temperature such that the flow control device is operated to inject hydrogen gas into the exhaust flow path when the temperature exceeds a predetermined threshold temperature necessary for combustion of the hydrogen gas at the DOC.

2. The work vehicle of claim 1, wherein the temperature sensor comprises a first temperature sensor, the temperature comprises a first temperature, and the temperature threshold comprises a first temperature threshold, further including a second temperature sensor sensing a second temperature associated with exhaust gases in the exhaust flow path proximate the NOx reduction device and the flow control device is operated to inject hydrogen gas into the exhaust flow path only when the second temperature is less than a second predetermined temperature threshold associated with activation of the NOx reduction device.

3. The work vehicle of claim 1, further including an oxygen sensor to sense oxygen in the exhaust gases in the exhaust flow path and wherein the flow control device is operated in accordance with the sensed oxygen.

4. A work vehicle, the work vehicle comprising:

an engine that generates exhaust gases that flow through an exhaust flow path;

a diesel oxidation catalyst (DOC) disposed in the exhaust flow path;

a nitrogen-oxide (NOx) reduction device disposed in the exhaust flow path;

a tank of hydrogen gas;

a temperature sensor sensing a temperature associated with the exhaust gases in the exhaust flow path proximate the DOC;

a flow control device between the tank of hydrogen gas and the exhaust flow path between the engine and the DOC, wherein the flow control device is operable to control a flow of hydrogen gas from the tank of hydrogen gas into the exhaust flow path; and a controller having a processor and memory architecture, wherein the controller is configured to operate the flow control device;

wherein the flow of hydrogen gas is adjusted in accordance with the sensed temperature; and wherein the controller is configured to estimate an expected change in an operating load of the engine and operate the flow control device in accordance with the expected change in the operating load.

5. The work vehicle of claim 4, wherein the controller estimates the expected change in the operating load in accordance one or more of fuel demand or airflow into the engine.

6. The work vehicle of claim 4, wherein the expected change in the operating load is an increase in the operating load and the controller operates the flow control device to reduce the flow of hydrogen gas.

7. The work vehicle of claim 4, wherein the controller operates the flow control device in accordance with an age of the DOC.

8. The work vehicle of claim 4, wherein the controller develops an estimate of an expected temperature of the exhaust gases in the exhaust flow path proximate the NOx reduction device in accordance with the estimate of the change in the operating load of the engine and operates the flow control device in accordance with the estimated expected temperature.

9. An aftertreatment system for a work vehicle having an engine that generates exhaust gases flowing through an exhaust flow path to an exhaust vent, the aftertreatment system comprising:

a diesel oxidation catalyst (DOC) disposed in the exhaust flow path;

a nitrogen-oxide (NOx) reduction device disposed in the exhaust flow path;

a temperature sensor sensing a temperature associated with the exhaust gases in the exhaust flow path proximate the DOC;

a tank of hydrogen gas; and a flow control device between the tank of hydrogen gas and the exhaust flow path between the engine and the DOC, wherein the flow control device is operable to control a flow of hydrogen gas from the tank of hydrogen gas into the exhaust flow path;

wherein the flow of hydrogen gas is adjusted in accordance with the sensed temperature such that the flow control device is operated to inject hydrogen gas into the exhaust flow path when the temperature exceeds a predetermined threshold temperature necessary for combustion of the hydrogen gas at the DOC.

10. The aftertreatment system of claim 9, wherein the temperature sensor comprises a first temperature sensor, the temperature comprises a first temperature, and the first temperature threshold comprises a first temperature threshold, further including a second temperature sensor sensing a second temperature associated with exhaust gases in the exhaust flow path proximate the NOx reduction device, wherein the flow control device is operated to inject hydrogen gas into the exhaust flow path only when the second temperature is less than a second predetermined temperature threshold associated with activation of the NOx reduction device.

11. The aftertreatment system of claim 9, further including an oxygen sensor to sense oxygen in the exhaust gases in the exhaust flow path and the flow control device is operated in accordance with the sensed oxygen.

12. An aftertreatment system for a work vehicle having an engine that generates exhaust gases flowing through an exhaust flow path to an exhaust vent, the aftertreatment system comprising:

a diesel oxidation catalyst (DOC) disposed in the exhaust flow path;

a nitrogen-oxide (NOx) reduction device disposed in the exhaust flow path;

a temperature sensor sensing a temperature associated with the exhaust gases in the exhaust flow path proximate the DOC;

a tank of hydrogen gas;

a flow control device between the tank of hydrogen gas and the exhaust flow path between the engine and the DOC, wherein the flow control device is operable to control a flow of hydrogen gas from the tank of hydrogen gas into the exhaust flow path; and a controller having a processor and memory architecture, wherein the controller is configured to operate the flow control device;

wherein the flow of hydrogen gas is adjusted in accordance with the sensed temperature; and wherein the controller is configured to estimate an expected change in an operating load of the engine and operate the flow control device in accordance with the expected change in the operating load.

13. The aftertreatment system of claim 12, wherein the controller estimates the expected change in the operating load in accordance with one or more of fuel demand or airflow into the engine.

14. The aftertreatment system of claim 12, wherein the expected change in the operating load is an increase in the operating load and the controller operates the flow control device to reduce the flow of the hydrogen gas.

15. The aftertreatment system of claim 12, wherein the controller operates the flow control device in accordance with an age of the DOC.

16. The aftertreatment system of claim 12, wherein the controller develops an estimate of an expected temperature of the exhaust gases in the exhaust flow path proximate the NOx reduction device in accordance with the estimate of the change in the operating load of the engine and operates the flow control device in accordance with the estimated expected temperature.

* * * * *